US007446667B2

(12) United States Patent
Peng et al.

(10) Patent No.: US 7,446,667 B2
(45) Date of Patent: Nov. 4, 2008

(54) SWITCH APPARATUS FOR STARTING ALARM CIRCUIT OF PORTABLE COMPUTER

(75) Inventors: Xiong-Dong Peng, Shenzhen (CN); Ke-Cheng Lin, Tu-Cheng (TW); Chien-Li Tsai, Tu-Cheng (TW); Wen-Kang Lo, Tu-Cheng (TW); Jie Zhang, Shenzhen (CN); Mao-Chang Huang, Tu-Cheng (TW)

(73) Assignees: Hong Fu Jin Precision Industry (ShenZhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 97 days.

(21) Appl. No.: 11/309,726

(22) Filed: Sep. 15, 2006

(65) Prior Publication Data

US 2007/0236348 A1 Oct. 11, 2007

(51) Int. Cl.

| | |
|---|---|
| ***G08B 21/00*** | (2006.01) |
| ***G08B 13/14*** | (2006.01) |
| ***H01R 13/70*** | (2006.01) |
| ***H01R 33/96*** | (2006.01) |

(52) U.S. Cl. ..... 340/665; 340/568.1; 340/571; 200/51 R; 200/51.09; 200/293; 200/294; 200/304; 200/341

(58) Field of Classification Search ..... None
See application file for complete search history.

(56) References Cited

U.S. PATENT DOCUMENTS 4,985,695 A * 1/1991 Wilkinson et al. ..... 340/568.3
5,936,526 A 8/1999 Klein

* cited by examiner

*Primary Examiner*—Julie Lieu
(74) *Attorney, Agent, or Firm*—Wei Te Chung

(57) ABSTRACT

A switch apparatus for activating an alarm function of an alarm circuit on a motherboard of a portable computer, the switch apparatus includes a switch mounted on the motherboard and a pressing device mounted on a base. The pressing device includes a pressing member deformable via an outside force to depress the switch.

9 Claims, 7 Drawing Sheets

SWITCH APPARATUS FOR STARTING ALARM CIRCUIT OF PORTABLE COMPUTER

FIELD OF THE INVENTION

The invention relates to a switch apparatus on a portable computer. In particular, the present invention relates to a switch apparatus for starting an alarm circuit of a portable computer.

DESCRIPTION OF RELATED ART

Theft protection is of particular concern to owners of portable computer systems. Portable computer systems, such as notebook and laptop computers, can be worth many thousands of dollars, and are small and easy to carry away. This has made portable computer systems a favorite target of thieves.

A conventional method for preventing a notebook computer from being stolen is to mount an alarm circuit on the notebook computer. When the notebook computer is moved while the alarm circuit is active, a switch apparatus activates the alarm circuit to sound an alarm.

However, limited space within a portable computer makes it difficult to conveniently place a switch apparatus in the computer.

What is needed is a convenient switch apparatus for starting an alarm circuit of a portable computer.

SUMMARY OF THE INVENTION

An exemplary switch apparatus for activating an alarm function of an alarm circuit on a motherboard of a portable computer, the switch apparatus includes a switch mounted on the motherboard and a pressing device mounted on a base. The pressing device includes a pressing member deformable via an outside force to depress the switch.

Other advantages and novel features will become more apparent from the following detailed description when taken in conjunction with the accompanying drawing, in which:

DETAILED DESCRIPTION OF THE INVENTION

Figure 1:
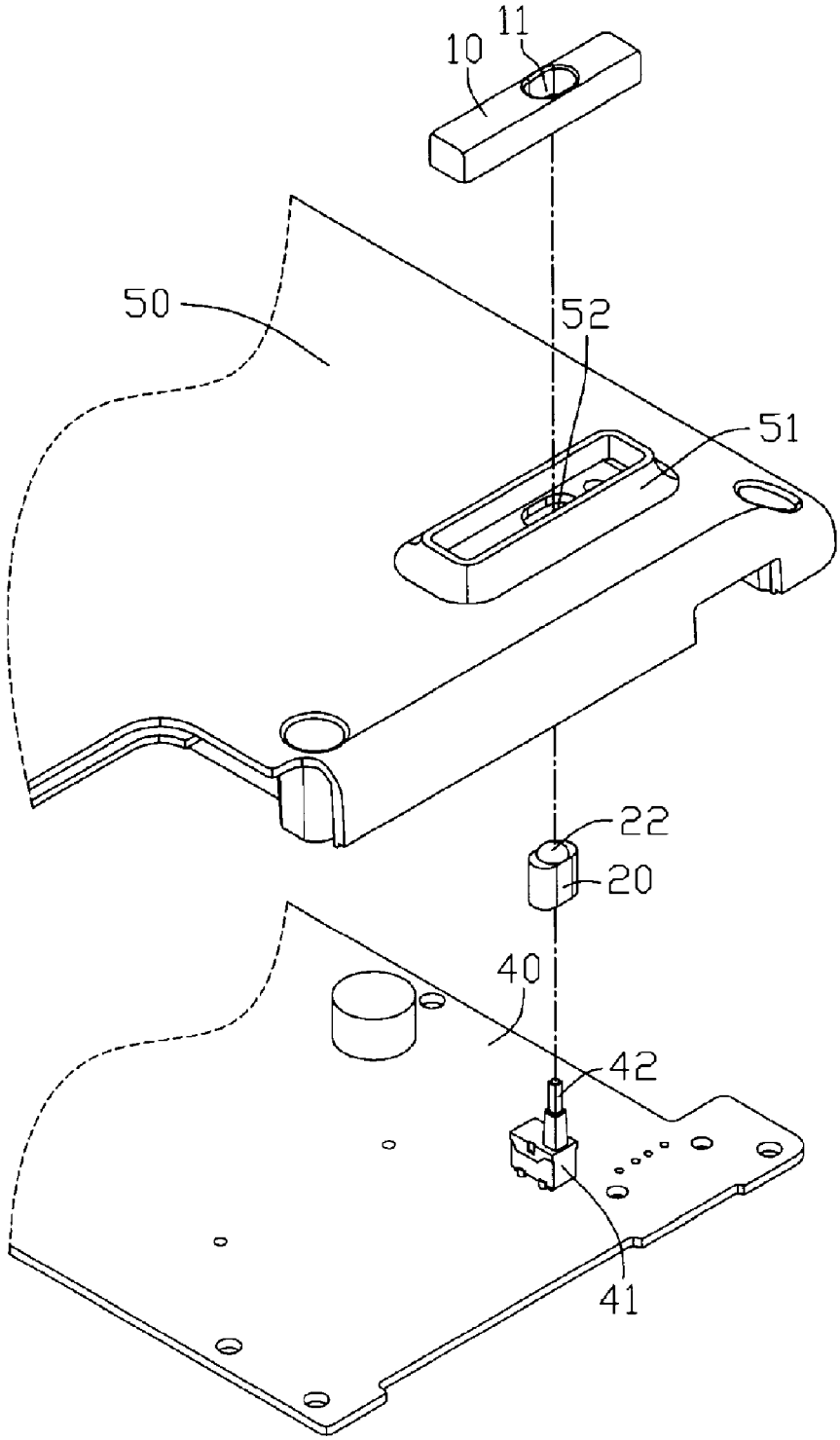
FIG. 1 is an exploded view of a switch apparatus in accordance with a first preferred embodiment of the present invention, with a partial view of a base and a motherboard of a notebook computer.
Figure 2:
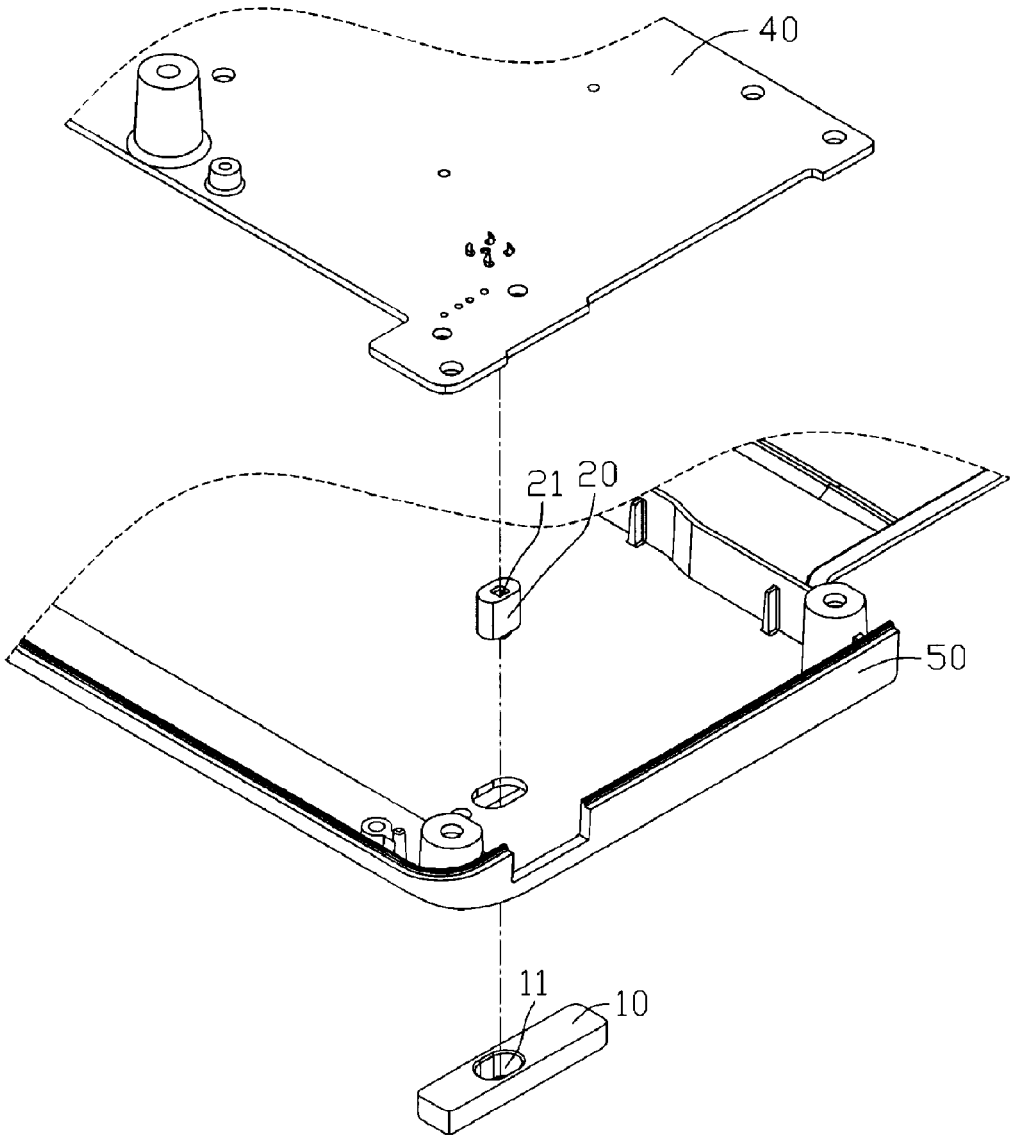
FIG. 2 is an inverted view of FIG. 1.

Referring to FIGS. 1 and 2, a switch apparatus in accordance with a first preferred embodiment of the present invention is provided for activating an alarm function of an alarm circuit of a notebook computer, the alarm circuit being controlled to be on or off by authorized user input such as a password. The switch apparatus includes a switch 41, a fastener 10 used as a pressing device, and a shield 20 to be placed on the switch 41. The switch 41 is mounted on a motherboard 40 of the notebook computer. The fastener 10 is mounted on a base 50 of the notebook computer.

The fastener 10 has a rectangular parallelepiped structure. A through hole 11 is defined in the midst of the fastener 10 for the shield 20 to pass through.

A pressing member 22 protrudes from a top of the shield 20, an aperture 21 is defined in a bottom of the shield 20. The pressing member 22 is made of one or more flexible materials such as rubber. The pressing member 22 is deformable with application of an outside force.

A touching pole 42 extends up from the switch 41. The touching pole 42 is inserted into the aperture 21 of the shield 20.

There are four support feet 51 on the base 50 for supporting the base 50. Each of the support feet 51 defines a rectangular parallelepiped space. One of the support feet 51 is used to accommodate the fastener 10. A bore 52 is defined in the base 50 for the shield 20 to pass through.

Figure 3:
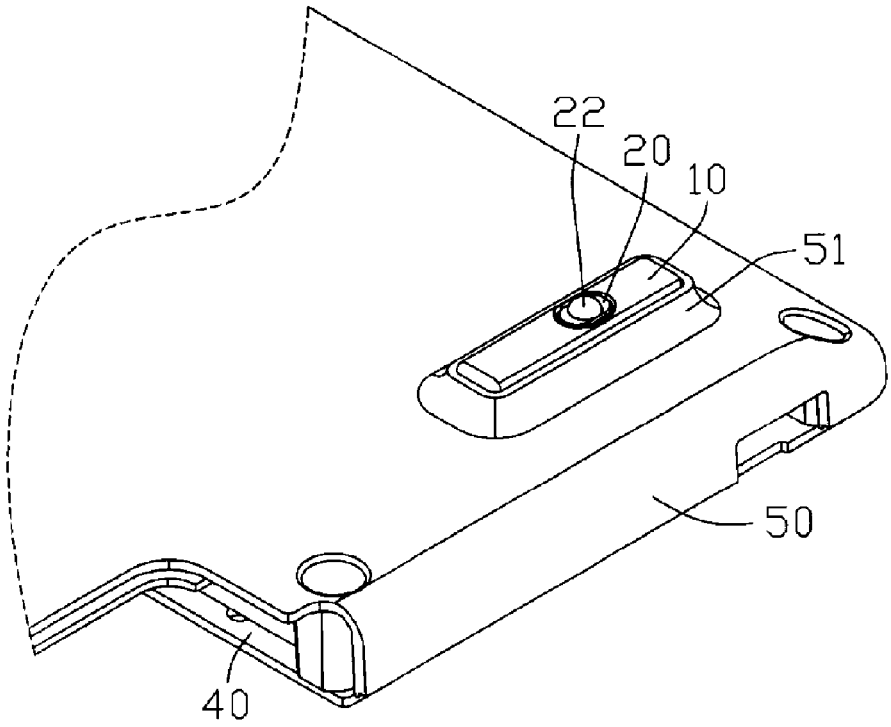
FIG. 3 is an assembled view of FIG. 1.
Figure 4:
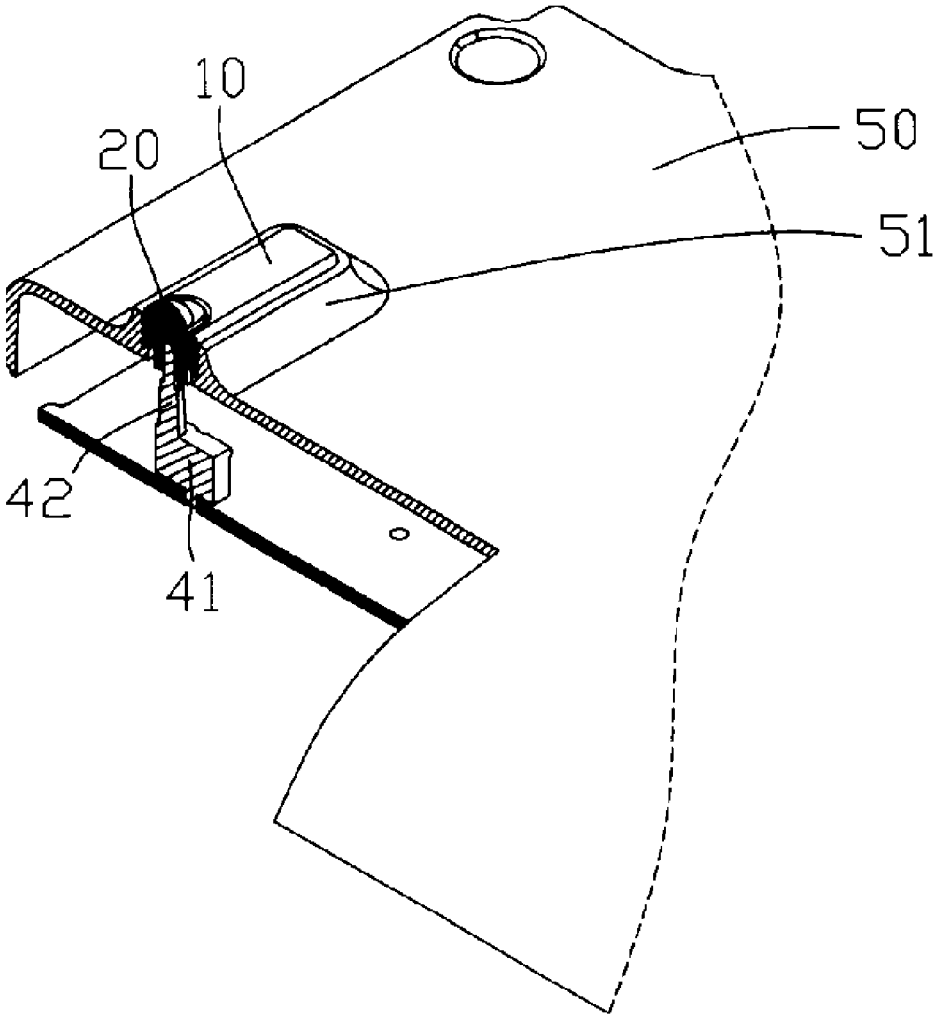
FIG. 4 is a partial sectional view of FIG. 3.

Referring to FIGS. 3 and 4, in assembly, the fastener 10 is mounted in the one of the support feet 51 of the base 50 via an adhesive such as glue. The shield 20 is extended through the bore 52 of the base 50 and the through hole 11 of the fastener 10, the shield 20 can also be glued on an inner face of the through hole 11 of the fastener 10 thereby being fixed to the fastener 10. The pressing member 22 of the shield 20 extends out from the fastener 10 to contact with a supporting surface. The touching pole 42 of the switch 41 is inserted into the aperture 21 of the shield 20. The pressing member 22 of the shield 20 touches without urging the touching pole 42 of the switch 41. The motherboard 40 is then mounted on the base 50.

When the base 50 of the notebook computer is laid on a supporting surface, the pressing member 22 of the shield 20 is deformed under pressure exerted by a weight of the notebook computer. Accordingly, the pressing member 22 now depresses the touching pole 42 of the switch 41 thereby opening the alarm circuit on the motherboard 40, at this time the notebook computer can be used normally. When the alarm circuit is active, and the notebook computer is moved from the supporting surface, the pressing member 22 of the shield 20 recovers from the elastic deflection and causes the touching pole 42 of the switch 41 to close the alarm circuit on the motherboard 40, activating an alarm.

Figure 5:
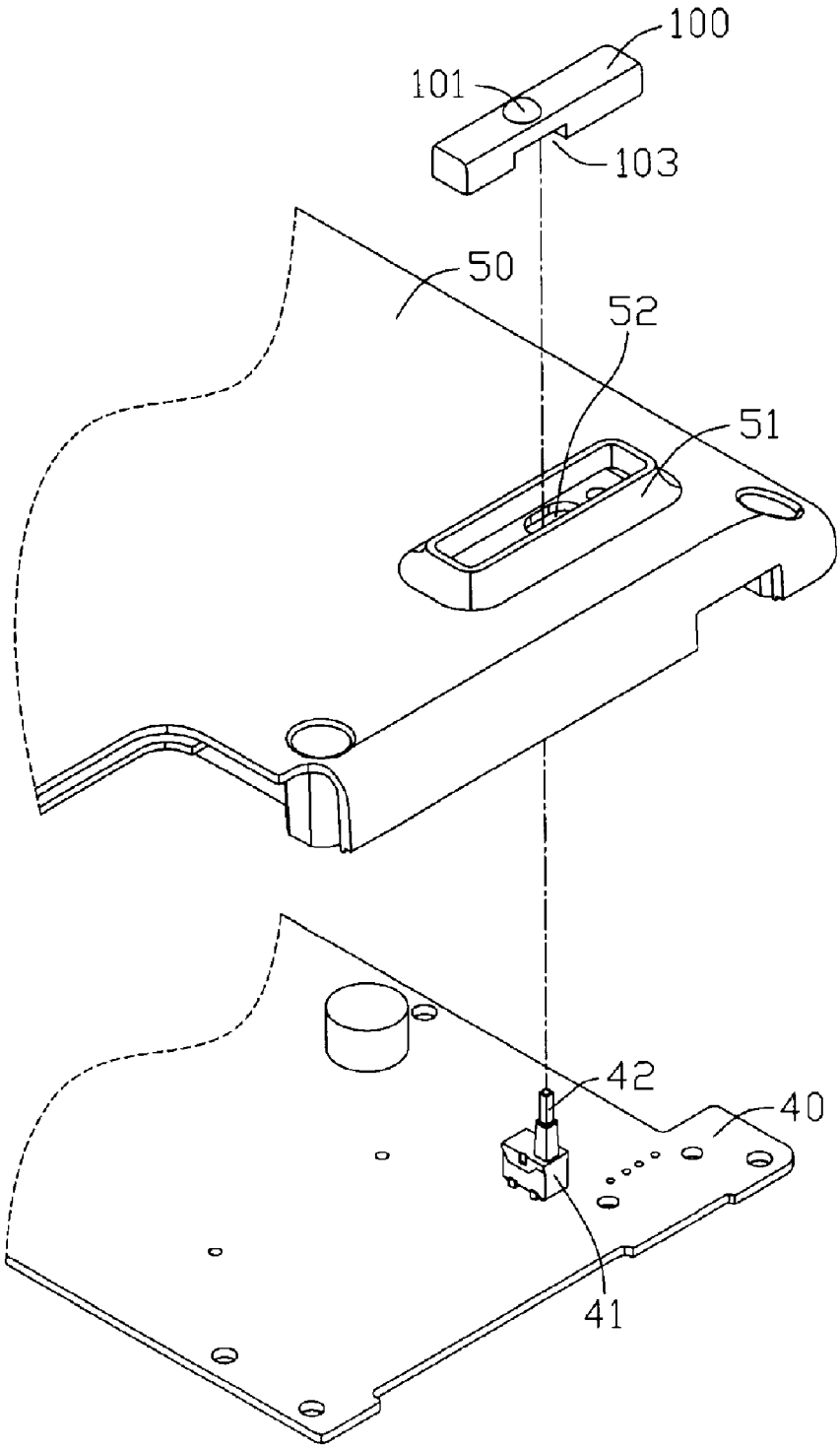
FIG. 5 is an exploded view of a switch apparatus in accordance with a second preferred embodiment of the present invention, with a partial view of a base and a motherboard of a notebook computer.
Figure 6:
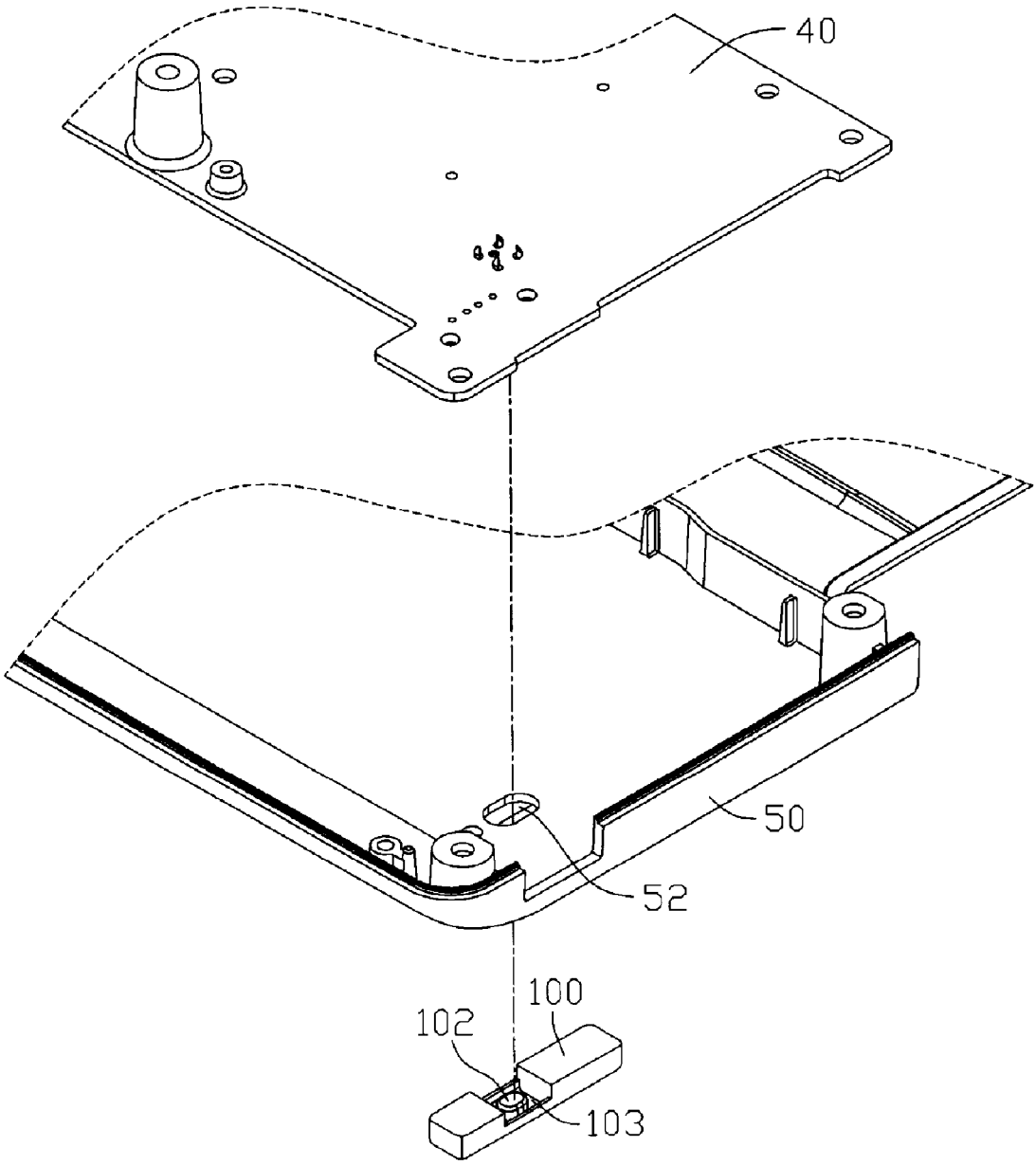
FIG. 6 is an inverted view of FIG. 5.
Figure 7:
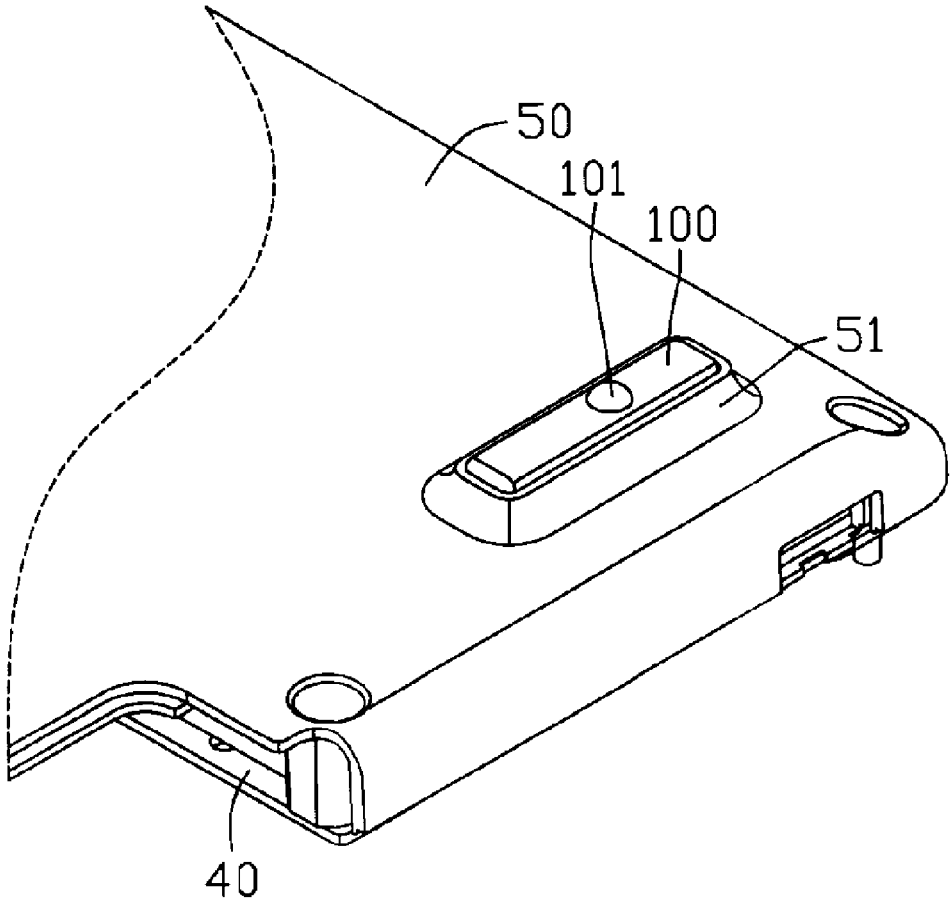
FIG. 7 is an assembled view of FIG. 5.

Referring to FIGS. 5, 6, and 7, a switch apparatus in accordance with a second preferred embodiment of the present invention has a similar configuration to the first preferred embodiment. What is different is that a fastener 100 is used as a pressing device. The fastener 100 has a rectangular parallelepiped structure and a pressing member is integrally formed on the fastener 100 instead of the pressing member 22 of the shield 20 in the first preferred embodiment. The pressing member includes an upper portion 101 on a top of the fastener 100 and a lower portion used as a protruding post 102. A cutout 103 is defined in a bottom of the fastener 100 and the protruding post 102 extends from the cutout 103. The pressing member is made of one or more flexible materials such as rubber. The pressing member is deformable with application of an outside force.

In assembly, the fastener 100 is mounted in the one of the support feet 51 of the base 50 via an adhesive such as glue, the touching pole 42 of the switch 41 is inserted into the bore 52 of the base 50. The protruding post 102 of the fastener 100 is touches without urging the touching pole 42 of the switch 41.

When the base 50 of the notebook computer is laid on a supporting surface, the pressing member of the fastener 100 is deformed under pressure exerted by a weight of the notebook computer. Accordingly the pressing member depresses the touching pole 42 of the switch 41 to open the alarm circuit on the motherboard 40, at this time the notebook computer can be used normally. With the alarm circuit activated, when the notebook computer is moved from the supporting surface, the pressing member of the fastener 100 recovers from the elastic deflection, which causes the touching pole 42 of the switch 41 to close the alarm circuit on the motherboard 40, thus activating an alarm. It is to be noted that in alternative embodiments the switch 41 can be configured to work with either a normally open circuit or a normally closed circuit and that other suitable fixing means may be used instead of adhesive to fix the fasteners 10, 100 in place.

It is to be understood, however, that even though numerous characteristics and advantages of the preferred embodiments have been set forth in the foregoing description, together with details of the structures and functions of the embodiments, the disclosure is illustrative only, and changes may be made in detail, especially in matters of shape, size, equivalent material and arrangement of parts within the principles of the invention to the full extent indicated by the broad general meaning of the terms in which the appended claims are expressed.

What is claimed is:

1. A switch apparatus for activating an alarm function of an alarm circuit on a motherboard of a portable computer, the switch apparatus comprising:

a switch mounted on the motherboard;

a pressing device mounted on a bottom of a base of the portable computer, the pressing device comprising a pressing member deformable via an outside force to depress the switch and a fastener accommodated in a support foot of the base, the pressing member received in the fastener and exposed out from the fastener; and a shield enclosing the switch and connected with the fastener, the pressing member being arranged on a top of the shield to actuate the switch.

2. The switch apparatus as claimed in claim 1, wherein the fastener defines a through hole, the shield is connected with the fastener through the through hole, the shield defines an aperture on a bottom thereof, the switch comprises a touching pole inserted into the aperture of the shield.

3. The switch apparatus as claimed in claim 1, wherein the pressing member is integrally formed on the fastener the switch comprises a touching pole extending through the base to contact with the pressing member.

4. A switch apparatus for activating an alarm function of an alarm circuit on a motherboard of a portable computer, the switch apparatus comprising:

a switch for activating the alarm function; and a pressing device mounted on a base of the portable computer comprising a pressing member, and a fastener accommodated in a support foot of the base; and a shield connected with the fastener;

wherein the pressing member is set on a top of the shield, the fastener defines a through hole, the shield is connected with the fastener through the through hole, the shield defines an aperture on a bottom thereof the switch comprises a touching pole inserted into the aperture of the shield, when the portable computer is placed on a supporting surface, the pressing member is deformed under pressure exerted by a weight of the portable computer to depress the switch to cut off the alarm circuit, when the portable computer is illegally moved, the pressing member looses the switch to start up the alarm circuit.

5. The switch apparatus as claimed in claim 4, wherein the pressing member is integrally formed on the fastener, the switch comprises a touching pole extending through the base to contact with the pressing member.

6. A computer comprising:

a base configured for sitting on a supporting surface, comprising a plurality of support feet configured for sitting on the supporting surface;

a motherboard mounted to the base, an alarm circuit and a switch for activating the alarm circuit being mounted on the motherboard;

an elastic pressing member mounted to and exposed out of the base, and mounted in one of the support feet;

a fastener accommodated in said one of the support feet; wherein the elastic pressing member is set on a top of a shield which is secured to said fastener; and wherein the elastic pressing member is deformable under a force exerted thereon to depress the switch to thereby cut off the alarm circuit and is restorable when the force is withdrawn to release the switch to thereby activate the alarm circuit, and the force is exerted by the supporting surface.

7. The computer as claimed in claim 6, further comprising a fastener accommodated in said one of the feet, the elastic pressing member being directly set on a top of the fastener, a protruding post integrally extending from the pressing member corresponding to the switch.

8. The computer as claimed in claim 6, wherein the switch comprises a touching pole, the elastic pressing member sitting on the touching pole.

9. The computer as claimed in claim 8, wherein the base defines a bore for extension of the touching pole of the switch to contact with the pressing member.

* * * * *